US006095015A

United States Patent [19]

Phelan

[11] Patent Number: 6,095,015

[45] Date of Patent: Aug. 1, 2000

[54] MECHANICAL SHINGLE REMOVER

[76] Inventor: James P. Phelan, 10533 Polk Square Ct., Gaithersburg, Md. 20878

[21] Appl. No.: 09/146,562

[22] Filed: Sep. 3, 1998

[51] Int. Cl.[7] ..... E04D 15/00

[52] U.S. Cl. ..... 81/45; 81/46; 30/170

[58] Field of Search ..... 81/45, 46; 30/169–170; 299/41.1

[56] References Cited

U.S. PATENT DOCUMENTS

| | | | |
|---|---|---|---|
| 4,663,995 | 5/1987 | Amundson et al. | 81/45 |
| 4,880,491 | 11/1989 | Jacobs et al. | 81/45 |
| 5,001,946 | 3/1991 | Shirlin et al. | 81/45 |
| 5,009,131 | 4/1991 | Alto et al. | 81/45 |
| 5,218,766 | 6/1993 | Himebaugh | 81/45 |
| 5,741,047 | 4/1998 | Ordonez | 81/45 |
| 5,893,611 | 4/1999 | Gamber | 81/45 |
| 5,921,155 | 7/1999 | Faller et al. | 81/45 |

*Primary Examiner*—James G. Smith
*Assistant Examiner*—Lee Wilson

[57] ABSTRACT

A mechanical shingle remover for removing shingles from a roof includes a pair of frame arms, a plate pivotally coupled at one end between the frame arms, and a machine for pivoting the free end of the plate away from the frame arms to lift shingles away from a roof. In a preferred embodiment, the device includes a pair of wheels and a handle for moving the device; a counterweight assembly coupled to a lifting arm for lifting the plate; and a number of rubber bushings having metal inner and outer coverings positioned at all the pivot points of the device. In a most preferred embodiment, an electric motor is powered by an electrical connection through a plug on the handle and controlled by a trigger on the handle.

12 Claims, 2 Drawing Sheets

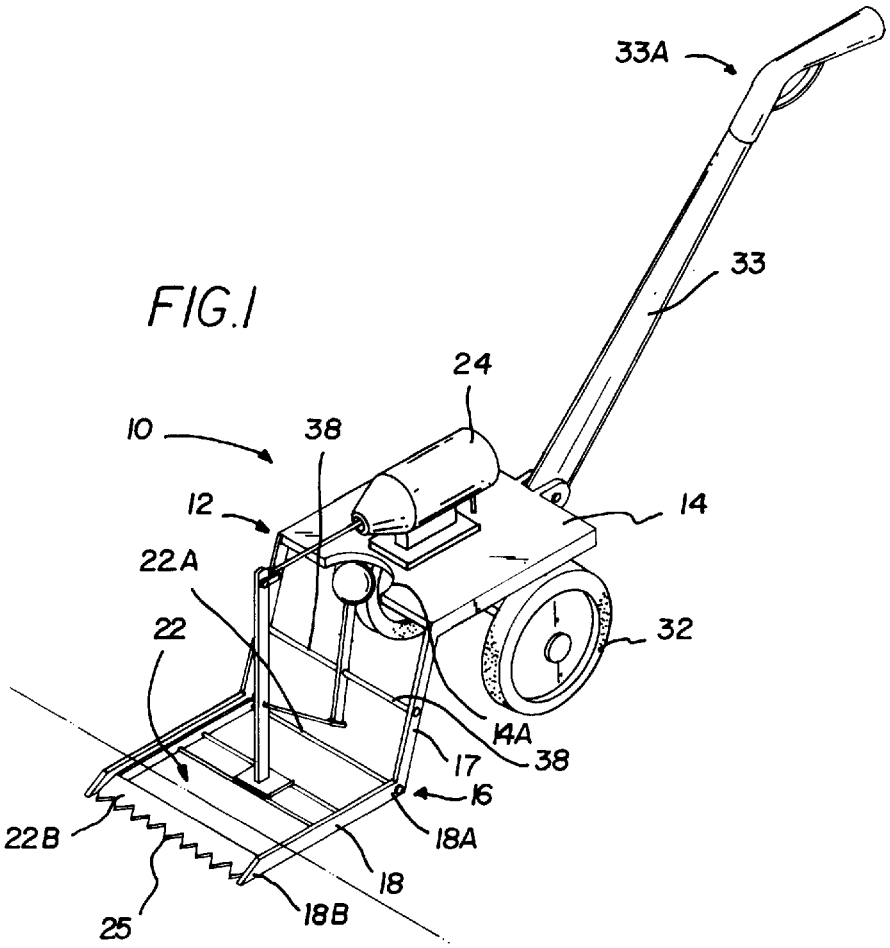
FIG.1
FIG.2
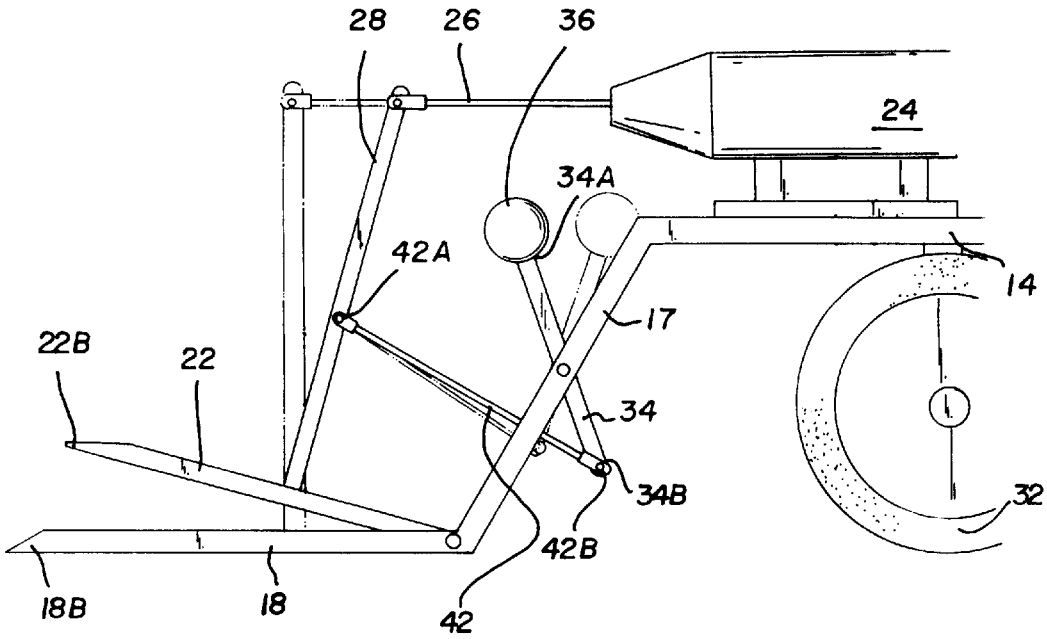

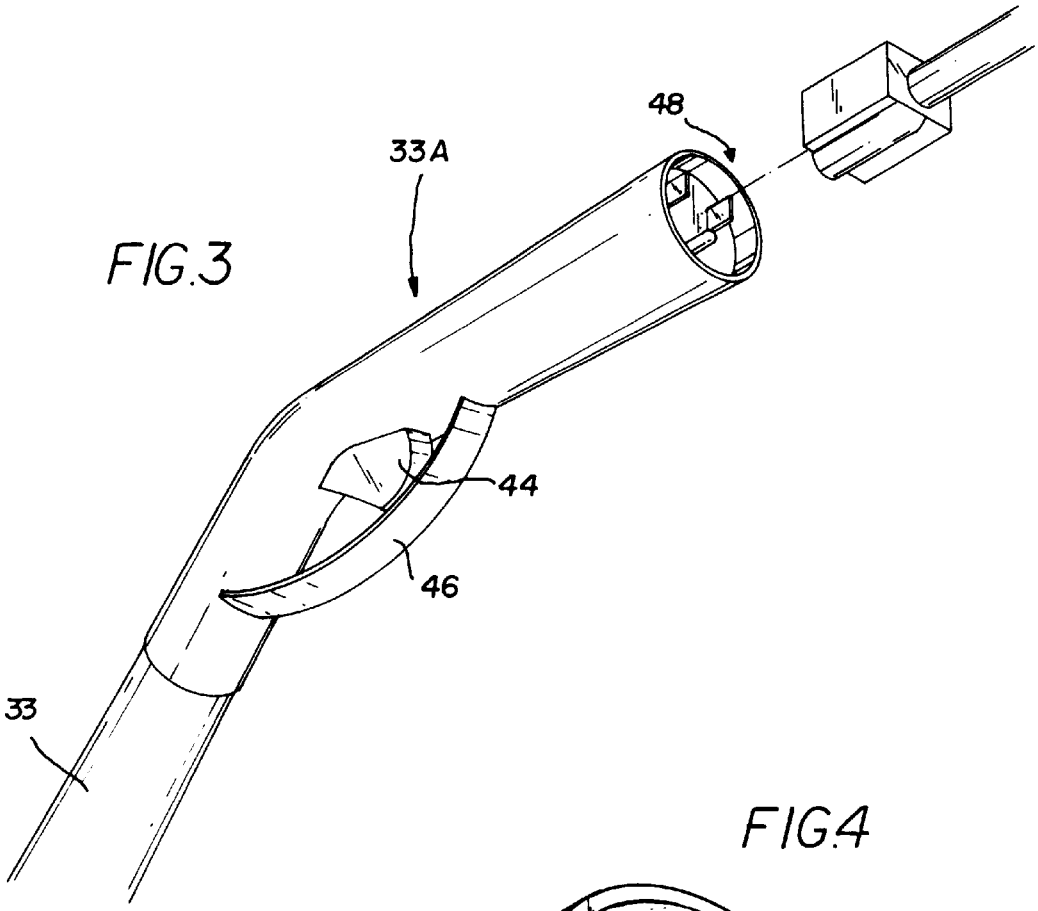
FIG.3
FIG.4
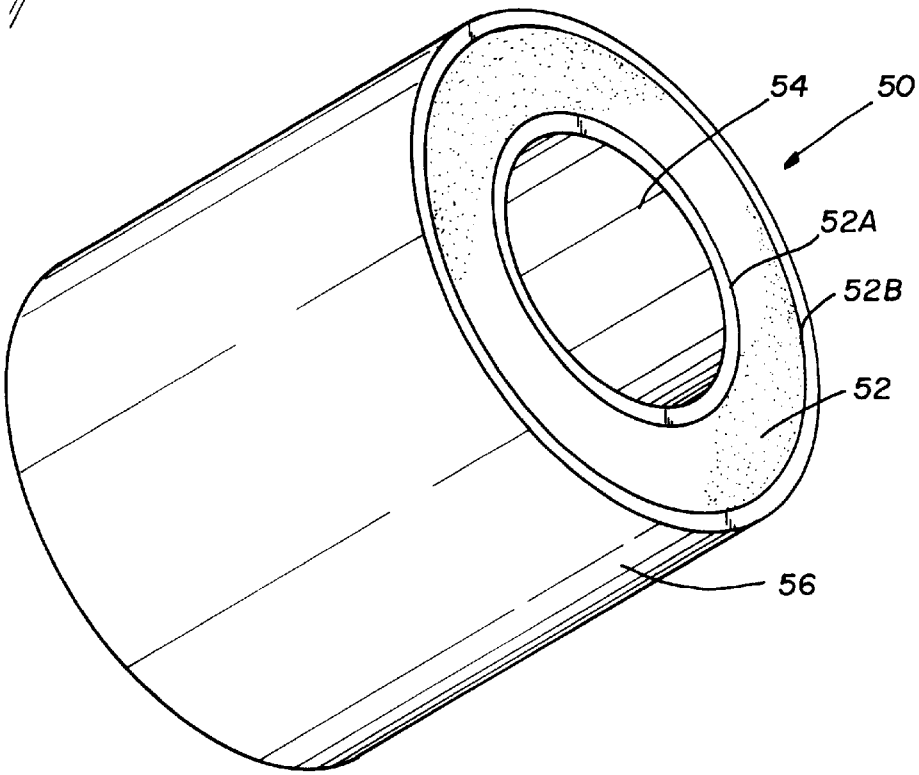

MECHANICAL SHINGLE REMOVER

BACKGROUND OF THE INVENTION

1. Field of the Invention

The present invention relates to roofing machines and more particularly pertains to a new mechanical shingle remover for removing shingles from a roof.

2. Description of the Prior Art

The use of roofing machines is known in the prior art. More specifically, roofing machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art roofing machines include U.S. Pat. No. 3,542,433; U.S. Pat. No. 4,837,933; U.S. Pat. No. 3,779,605; U.S. Pat. No. 3,695,713; U.S. Pat. No. 2,279,454; and U.S. Pat. No. Des. 359,434.

While these devices fulfill their respective, particular objectives and requirements, the aforementioned patents do not disclose a new mechanical shingle remover. The inventive device includes a pair of frame arms, a plate pivotally coupled at one end between the frame arms, and a motor for pivoting the free end of the plate away from the frame arms to lift shingles away from a roof.

In these respects, the mechanical shingle remover according to the present invention substantially departs from the conventional concepts and designs of the prior art, and in so doing provides an apparatus primarily developed for the purpose of removing shingles from a roof.

SUMMARY OF THE INVENTION

In view of the foregoing disadvantages inherent in the known types of roofing machines now present in the prior art, the present invention provides a new mechanical shingle remover construction wherein the same can be utilized for removing shingles from a roof.

The general purpose of the present invention, which will be described subsequently in greater detail, is to provide a new mechanical shingle remover apparatus and method which has many of the advantages of the roofing machines mentioned heretofore and many novel features that result in a new mechanical shingle remover which is not anticipated, rendered obvious, suggested, or even implied by any of the prior art roofing machines, either alone or in any combination thereof.

To attain this, the present invention generally comprises a pair of frame arms, a plate pivotally coupled at one end between the frame arms, and a motor for pivoting the free end of the plate away from the frame arms to lift shingles away from a roof.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new mechanical shingle remover apparatus and method which has many of the advantages of the roofing machines mentioned heretofore and many novel features that result in a new mechanical shingle remover which is not anticipated, rendered obvious, suggested, or even implied by any of the prior art roofing machines, either alone or in any combination thereof.

It is another object of the present invention to provide a new mechanical shingle remover which may be easily and efficiently manufactured and marketed.

It is a further object of the present invention to provide a new mechanical shingle remover which is of a durable and reliable construction.

An even further object of the present invention is to provide a new mechanical shingle remover which is susceptible of a low cost of manufacture with regard to both materials and labor, and which accordingly is then susceptible of low prices of sale to the consuming public, thereby making such mechanical shingle remover economically available to the buying public.

Still yet another object of the present invention is to provide a new mechanical shingle remover which provides in the apparatuses and methods of the prior art some of the advantages thereof, while simultaneously overcoming some of the disadvantages normally associated therewith.

Still another object of the present invention is to provide a new mechanical shingle remover for removing shingles from a roof.

Yet another object of the present invention is to provide a new mechanical shingle remover which includes a pair of frame arms, a plate pivotally coupled at one end between the frame arms, and a motor for pivoting the free end of the plate away from the frame arms to lift shingles away from a roof.

Still yet another object of the present invention is to provide a new mechanical shingle remover that is relatively light weight and safe for use on a roof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new mechanical shingle remover according to the present invention.

FIG. 2 is a partial side view of the present invention.

FIG. 3 is a perspective view of the handle of the present invention.

FIG. 4 is a perspective view of the preferred bushings for the pivot points of the present invention.

DESCRIPTION OF THE PREFERRED EMBODIMENT

With reference now to the drawings, and in particular to FIGS. 1 through 4 thereof, a new mechanical shingle remover embodying the principles and concepts of the present invention and generally designated by the reference numeral 10 will be described.

As best illustrated in FIGS. 1 through 4, the mechanical shingle remover 10 comprises a frame 12 has a deck 14 and a pair of outwardly extending substantially parallel frame arms 16. Each frame arm 16 has a first portion 17 and a second portion 18. The first portion 17 is extended downwardly from the deck 14 and the second portion 18 is extended outwardly from a lowermost end of the first portion 17. Each second portion 18 has a first end 18A and a distal end 18B opposite the first end 18A. The distal end 18B is tapered for insertion between a shingle and a roof.

A plate 22 is positioned between the second portions 18 of the frame arms 16. The plate 22 has a first end 22A and a tapered distal end 22B having teeth 25. The first end 22A is pivotally coupled between the first ends 18A of the second portion 18 of the frame arms 16 such that the distal end 22B of the plate 22 is substantially aligned with the distal ends 18B of the second portions 18 of the frame arms 16 to define a closed position. The plate 22 is pivotable with respect to the second portion 18 of the frame arms 16 such that the distal end 22B of the plate 22 is selectively movable to a position in spaced relationship above the distal ends 18B of the second portions 18 of the frame arms 16 to define an open position.

A reciprocating motor 24 has a motor shaft 26 pivotally coupled to a lifting arm 28. The lifting arm 28 is substantially orthogonally coupled to an upper surface of the plate 22 for pivoting the plate 22 between the closed position and the open position.

A pair of wheels 32 are extended downwardly from a bottom surface of the frame 12.

A handle 33 is coupled to the deck 14 of the frame 12 and extends outwardly from the deck 14 opposite the frame arms 16.

The reciprocating motor 24 is coupled to the deck 14 of the frame 12 such that a center of gravity of the reciprocating motor 24 is positioned substantially forward of the wheels 32 such that the device does not tilt backwards when at rest.

A first counterweight arm 34 has a weight 36 positioned at a first end 34A and a pair of connecting arms 38 extending outwardly from a medial portion of the first counterweight arm 34. The connecting arms 38 are designed for pivotally connecting to respective medial portions of the first portions 17 of the frame arms 16.

A second counterweight arm 42 has a first end 42A pivotally connected to a second end 34B of the first counterweight arm 34, a second end 42B of the second counter weight arm 42 is pivotally coupled to a medial portion of the lifting arm 28 such that the weight 36 pivots forwardly when the reciprocating motor 24 urges a top of the lifting arm 28 in a rearward direction.

A trigger 44 is positioned at a gripping end 33A of the handle 33. The trigger 44 is designed for actuating the reciprocating motor 24 such that the reciprocating motor 24 moves the plate 22 between the open and closed positions. A substantially arcuate trigger guard 46 is positioned over the trigger 44 for preventing accidental activation of the reciprocating motor 24.

The motor 24 is electrically connected to a plug 48 positioned at a distal end of the handle 33 for coupling to a power cord for providing electrical current to power the motor 24.

A forward edge of the deck 14 has a notch 14A positioned such that the weight 36 can swing through the notch 14A for preventing contact between the weight 36 and the deck 14.

A plurality of bushings 50, as shown in FIG. 4, are positioned at the pivotal couplings between the plate 22 and the first ends 18A of the second portion 18 of the frame arms 16, between the lifting arm 28 and the motor shaft 26, between the medial portion of the lifting arm 28 and the second counterweight arm 42, between the first counterweight arm 34 and the second counterweight arm 42, and between the connecting arms 38 and the medial portions of the first portion 17 of the frame arms 16. Each bushing 50 has an elongate annular rubber member 52, an annular metal inner member 54 coupled to an inner surface 52A of the rubber member 52, and an annular outer metal member 56 coupled to an outer surface 52B of the rubber member 52.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for removing shingles from a roof, the device comprising:

a frame having a pair of outwardly extending substantially parallel frame arms, the frame arms each having a base end and a distal end opposite the base end, the frame arms lying in a common plane, the distal end of the each frame arm being adapted for insertion between a shingle and a roof;

a substantially planar plate being positioned between the arms, the plate having a first end and a distal end, the plate having a closed position in which the plate lies in substantially the same plane as the frame arms for facilitating insertion of the frame arms and plate between the shingle and the root, the first end of the plate being pivotally coupled to the base ends of the frame arms such that the distal end of the plate is pivotable upward with respect to the frame arms and out of the common plane of the frame arms to define an open position of the plate;

a machine coupled to the plate for pivoting the plate between the closed position and the open position;

wherein the frame further includes a deck, the machine being coupled to the deck or the frame.

2. The device of claim 1 further comprising:

a pair of wheels coupled to the frame; and a handle coupled to the frame and extending outwardly from the frame.

3. A device for removing shingles from a roof, the device comprising:

a frame having a pair of outwardly extending substantially parallel frame arms, the frame arms each having a distal end, the distal end of the each frame arm being adapted for insertion between a shingle and a roof;

a plate being positioned between the arms, the plate having a first end and a distal end, the first end being pivotally coupled between the frame arms such that the distal end of the plate is substantially aligned with the distal ends of the frame arms to define a closed position;

the plate being pivotable with respect to the frame arms such that the distal end of the plate is positionable in spaced relationship above the frame arms to define an open position;

a reciprocating motor coupled to the plate for pivoting the plate between the closed position and the open position;

a pair of wheels coupled to the frame;

a handle coupled to the frame and extending outwardly from the frame;

wherein the frame further includes a deck, the motor being coupled to the deck of the frame.

4. The device of claim 3 wherein the motor is electrically connected to a plug positioned at a distal end of the handle, the plug being adapted for coupling to a power cord for providing electrical current to power the motor.

5. The device of claim 4 wherein the handle further includes a gripping portion having an actuation means for controlling electrical current to the motor such that a user can selectively activate the motor.

6. The device of claim 5 wherein the actuation means is a trigger electrically connected between the plug and the motor.

7. The device of claim 6 wherein the handle includes a substantially arcuate trigger guard positioned over the trigger to prevent accidental activation of the motor.

8. The device of claim 3 wherein the reciprocating motor includes a motor shaft pivotally coupled to a lifting arm, the lifting arm being substantially orthogonally coupled to the plate.

9. The device of claim 8 wherein the lifting arm is pivotally coupled to a counterweight assembly.

10. The device of claim 9 wherein the counterweight assembly comprises:

a first counterweight arm having a weight positioned at a first end and a pair of connecting arms extending outwardly therefrom for pivotally connecting between the frame arms; and a second counterweight arm having a first end pivotally connected to a second end of the first counterweight arm, a second end of the second counter weight arm being pivotally coupled to the lifting arm such that the weight pivots forwardly when the reciprocating motor urges a top of the lifting arm in a rearward direction.

11. A device for removing shingles from a roof, the device comprising:

a frame having a deck and a pair of outwardly extending substantially parallel frame arms, each arm having a first portion and a second portion, the first portion being extended downwardly from the deck, the second portion being extended outwardly from a lowermost end of the first portion, each second portion having a first end and a distal end opposite the first end, the distal end of each second portion being adapted for insertion between a shingle and a roof;

a plate being positioned between the second portions of the frame arms, the plate having a first end and a distal end, the first end being pivotally coupled between the first ends of the second portion of the frame arms such that the distal end of the plate is substantially aligned with the distal ends of the second portions of the frame arms to define a closed position adapted for insertion between shingles and a roof;

the plate being pivotable with respect to the second portion of the frame arms such that the distal end of the plate is selectively movable to a position in spaced relationship above the distal ends of the second portions of the frame arms to define an open position;

a reciprocating motor having a motor shaft extending therefrom, the motor shaft being pivotally coupled to a lifting arm, the lifting arm being substantially orthogonally coupled to an upper surface of the plate for pivoting the plate between the closed position and the open position;

a pair of wheels being extended downwardly from a bottom surface of the frame;

a handle coupled to the deck of the frame and extending outwardly from the deck opposite the frame arms;

wherein the reciprocating motor is coupled to the deck of the frame such that a center of gravity of the reciprocating motor is positioned substantially forward of the wheels such that the device does not tilt backwards when at rest;

a first counterweight arm having a weight positioned at a first end and a pair of connecting arms extending outwardly from a medial portion of the first counterweight arm, the connecting arms being for pivotally connecting to respective medial portions of the first portions of the frame arms;

a second counterweight arm having a first end pivotally connected to a second end of the first counterweight arm, a second end of the second counter weight arm being pivotally coupled to a medial portion of the lifting arm such that the weight pivots forwardly when the reciprocating motor urges a top of the lifting arm in a rearward direction;

a trigger positioned at a gripping end of the handle, the trigger being for actuating the reciprocating motor such that the reciprocating motor moves the plate between the open and closed positions;

a substantially arcuate trigger guard positioned over the trigger for preventing accidental activation of the reciprocating motor;

a forward edge of the deck having a notch positioned such that the weight can swing through the notch for preventing contact between the weight and the deck;

wherein the distal end of each second portion of the frame arms is tapered for facilitating insertion of the second portion of the frame arms between shingles and a roof; and wherein the distal end of the plate is tapered and includes a plurality of teeth.

12. The device of claim 11 further comprising a plurality of bushings positioned at the pivotal couplings between the plate and the first ends of the second portion of the frame arms, between the lifting arm and the motor shaft, between the medial portion of the lifting arm and the second counterweight arm, between the first counterweight arm and the second counterweight arm, and between the connecting arms and the medial portions of the first portion of the frame arms; and wherein each bushing includes an elongate annular rubber member, an annular metal inner member coupled to an inner surface of the rubber member, and an annular outer metal member coupled to an outer surface of the rubber member.

* * * * *